United States Patent [19]

Kistner

[11] Patent Number: 4,932,354

[45] **Date of Patent: * Jun. 12, 1990**

[54] MOVEABLE SPRAY ENCLOSURE

[75] Inventor: Kenneth J. Kistner, Midlothian, Tex.

[73] Assignee: Specified Equipment Systems Co., Inc., Dallas, Tex.

[ * ] Notice: The portion of the term of this patent subsequent to Sep. 13, 2005 has been disclaimed.

[21] Appl. No.: 243,503

[22] Filed: Sep. 12, 1988

Related U.S. Application Data

[63] Continuation of Ser. No. 19,677, Feb. 27, 1987, Pat. No. 4,770,088.

[51] Int. Cl.[5] ..... B05B 15/12

[52] U.S. Cl. ..... 118/305; 55/DIG. 46; 98/115.2; 98/115.4; 135/90; 135/900; 135/DIG. 9; 118/326; 118/DIG. 7; 160/351

[58] Field of Search ..... 118/108, 207, 305, 326, 118/634, DIG. 7; 135/87, 90, 101, 900, 901, DIG. 9; 52/64, 79.1, 239; 98/115.2, 115.4; 55/DIG. 46; 160/330, 351

[56] References Cited

U.S. PATENT DOCUMENTS

| | | | |
|---|---|---|---|
| 1,229,046 | 6/1917 | De Vilbiss | 118/DIG. 7 |
| 1,759,628 | 5/1930 | Pellegrino | 135/90 |
| 1,769,397 | 7/1930 | Strickland | 118/326 |
| 1,796,567 | 3/1931 | Kemp | 135/90 |
| 1,828,535 | 10/1931 | Kass | 135/90 |
| 1,900,274 | 3/1933 | Brockie | 135/90 |
| 1,977,386 | 10/1934 | Holes | 98/115.4 |
| 2,027,551 | 1/1936 | Rideout | 135/90 |
| 2,104,062 | 1/1938 | Temple | 118/305 |
| 2,280,984 | 4/1942 | Thurnau | 118/326 |
| 2,743,661 | 5/1956 | Schanz | 98/115.4 |
| 2,825,351 | 3/1958 | Thornton | 135/90 |
| 3,004,769 | 10/1961 | Turner | 160/330 |
| 3,356,070 | 12/1967 | Martin | 118/301 |
| 3,418,672 | 12/1968 | Regan | 118/305 |
| 3,463,174 | 8/1969 | Heller | 160/330 |
| 3,596,977 | 8/1971 | Bunger | 135/90 |
| 3,709,194 | 1/1973 | Hammelmann | 118/305 |
| 3,820,627 | 6/1974 | Wirt | 98/115.4 |
| 3,913,598 | 10/1975 | Glutting, Jr. et al. | 135/4 R |
| 3,926,104 | 12/1975 | El Dorado | 98/115.4 |
| 4,161,850 | 7/1979 | Peterson et al. | 52/65 |
| 4,231,289 | 11/1980 | Domicent | 118/326 |
| 4,315,458 | 2/1982 | Hudson, III | 118/326 |
| 4,532,886 | 8/1985 | Bouchard | 118/326 |
| 4,541,750 | 9/1985 | Owens | 118/305 |
| 4,543,908 | 10/1985 | Walberg | 118/326 |
| 4,662,309 | 5/1987 | Mulder | 118/326 |
| 4,682,448 | 7/1987 | Healey | 135/90 |
| 4,770,088 | 9/1988 | Kistner | 135/90 |

FOREIGN PATENT DOCUMENTS

| | | | |
|---|---|---|---|
| 93890 | 5/1959 | Norway | 135/900 |
| 0528142 | 10/1940 | United Kingdom | 160/229 |
| 2081337 | 2/1982 | United Kingdom | 160/351 |

*Primary Examiner*—James C. Housel
*Attorney, Agent, or Firm*—Richards, Medlock & Andrews

[57] ABSTRACT

A moveable enclosure for use in applying a sprayed material on the surface over which the enclosure is moved includes a frame assembly defining a plurality of side walls with rollers for movably supporting the frame. A mesh skirt is supported by the frame adjacent the plurality of side walls and is positioned with its lower edge adjacent the surface. A mesh top canopy is positioned on the top of the frame with its lower edge overlying the upper portion of the skirt to complete the enclosure.

42 Claims, 7 Drawing Sheets

FIG. 9
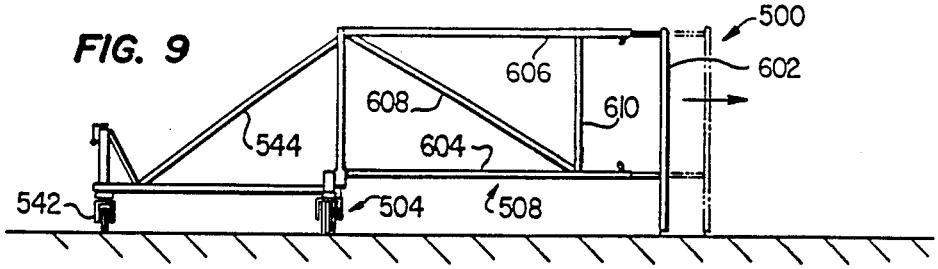
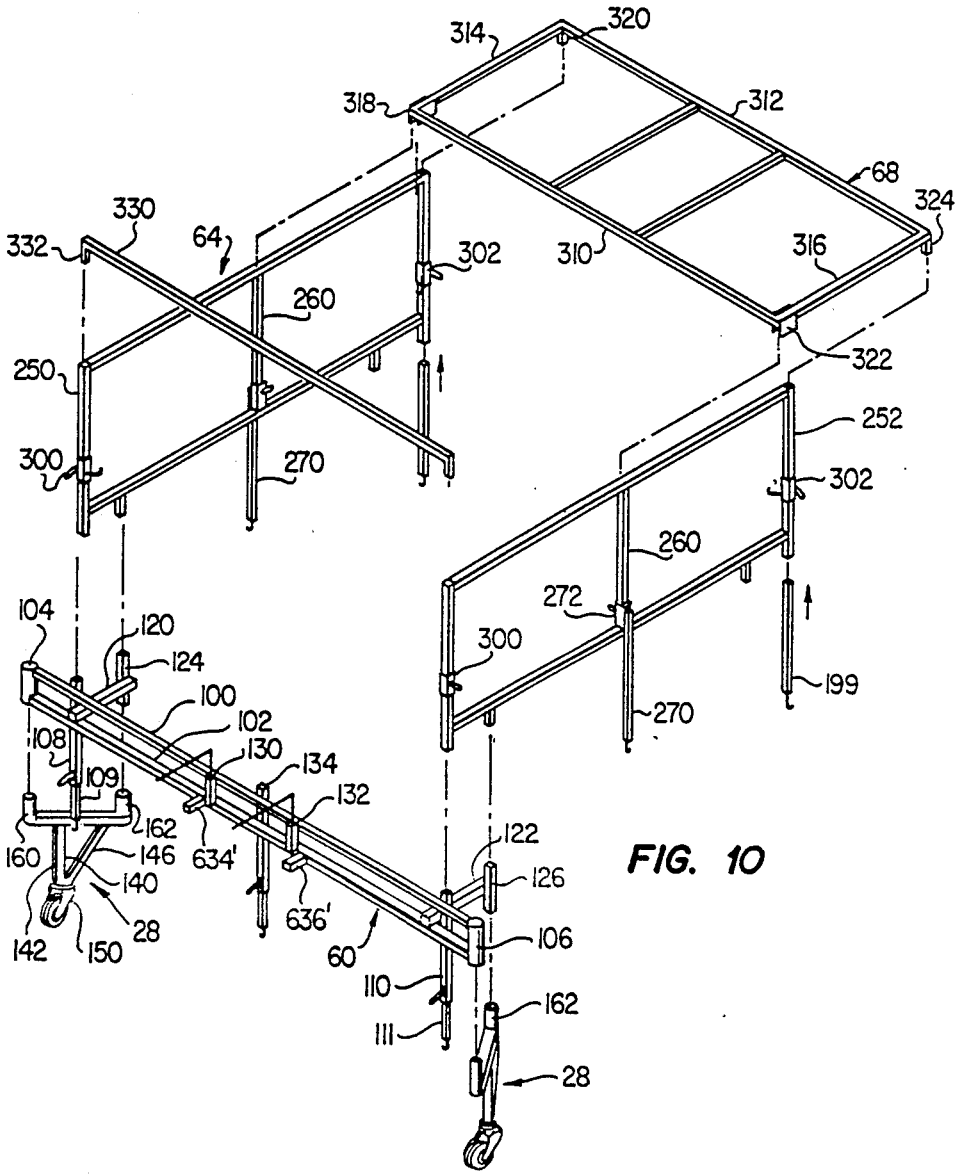
FIG. 10

MOVEABLE SPRAY ENCLOSURE

This is a continuation of application Ser. No. 019,677, filed Feb. 27, 1987, now U.S. Pat. No. 4,770,088.

TECHNICAL FIELD

The present invention relates to a spray enclosure for use in spraying materials on open surfaces, such as building roofs, and more particularly to an enclosure which prevents overspray of such material as it is applied while providing a moveable enclosure to facilitate application of the spray to the entire surface.

BACKGROUND ART

Waterproofing of roofs of commercial buildings is regularly achieved by applying polyurethane foam to the roof by spraying, followed by applying a sealer or protective coating. While the polyurethane foam material used for such projects has been refined over many years of development, the application of such materials on roof tops has continued to present the problems caused by overspray.

In applying such materials under conventional practices, a controlled mixture of components is produced at the site and is sprayed, under pressure, onto the roof top, using a manually controlled, hand-held applicator. Atomized particles of polyurethane are emitted and can be carried by wind or any air current from the roof top and deposited to the surrounding area. Generally, such polyurethane foam does not set up until it contacts the surface on which it is deposited. Thus, in most cases, any overspray of material will result in damage occasioned by deposit onto the surrounding area. For example, overspray resulting from the application of polyurethane foam on a commercial structure in a built up area, can expose hundreds if not thousands, of automobiles, as well as equipment and other buildings to the overspray. Such exposure can result in large damage claims.

As a result, spraying of polyurethane foam on commercial buildings is greatly restricted as a result of wind conditions and postponing the application of polyurethane foam is often required because of high wind conditions which cause overspray, even though the other conditions for spraying are ideal and equipment and manpower available. As a result of the possibility of damage which can result from overspray, an operator must balance such liability against the loss which is occasioned by excessive down time. Further, liability and loss as a result of overspray has had a dramatic impact on the cost of liability insurance and the amount of such insurance which a contractor can carry. Excessive liability claims may even result in the disqualification for insurance coverage.

As a result of such potential damage which can be caused from overspray of polyurethane foam, as well as other materials which are used on roof tops of commercial or other buildings, a need has existed for some time for a method and structure which would eliminate such problem. In the past, attempts have been made to erect wind screens which would act as a barrier between wind and the polyurethane foam as it is sprayed. However, such wind screens have proved to be ineffective in that they have been incapable of preventing movement of wind either around or over the screen to then affect the polyurethane spray. Likewise, shifting of wind direction and controlling wind gusts from various directions have rendered such wind screens ineffective.

The development of a successful enclosure in which the spraying can be conducted, has also not been successfully achieved. First, because such structure must be positioned at the top of a building structure, its construction, including weight and assembly, has been a hindrance to developing a successful product. Further, any bearer to the polyurethane spray must provide proper ventilation and be stable in operation. Further, such a device would have to be highly maneuverable to be capable of traversing all areas on a roof top, even those which have protrusions therethrough and are of irregular shape.

U.S. Pat. No. 4,315,458, to Raymond M. Hudson, entitled "Ventilated Wind-Diverter Shed for Man-Spraying of Polyurethane Foam From Within onto Roofs" discloses a motorized shed which travels on a rail to traverse a roof top for spraying of polyurethane foam from within. The structure is primarily devised to provide a lower wind diverter section with a ventilated upper portion. The equipment requires movement on a rail which of course severely restricts use of the device. Further, no specific structure for the shed is shown, only a diagrammatic view being depicted in the patent.

DISCLOSURE OF THE INVENTION

The present invention is directed to a movable enclosure which is designed to overcome the problems hereinabove enumerated as well as the deficiencies described with respect to the prior attempts to resolve such problems. In a primary embodiment, the present invention provides a moveable enclosure for use in applying a sprayed material on the surface over which the enclosure is moved. The enclosure includes a frame assembly defining a plurality of side walls with roller means for movably supporting the frame. A mesh skirt is supported by the frame adjacent the plurality of side walls and is positioned with its lower edge adjacent the surface. A mesh top canopy is positioned on the top of the frame with its lower edge overlying the upper portion of the skirt to complete the enclosure.

In a primary embodiment of the invention, the mesh skirt is positioned within the frame and is vertically adjustable relative to the frame. With respect to the adjustment of the skirt relative to the frame, both the upper portion and lower edge of the skirt are adjustable relative to the frame. In a preferred embodiment, the structure includes a skirt support bar removably attached within the frame for supporting the upper edge of the mesh skirt interiorly of the frame.

In a further embodiment of the invention, the frame assembly comprises first and second end beams, with side frames slidably engaging the ends of the end beams. The side frames each comprise tubular members forming a rectangular, planar frame with a pair of protrusions on each end thereof. These protrusions are slidably engagable into receiving tubes on the end beams. A top frame completes the frame assembly and has engagement means for slidably engaging within each of the side frames. Specifically, the top frame includes tubular members forming a rectangular planar frame with protrusions extending from the top frame perpendicular to the plane of the frame. The protrusions slidably engage the side frames.

In a further embodiment of the invention, the enclosure is freely movable on a plurality of wheel assemblies. A pair of steering wheel assemblies are removably attached adjacent the ends of the first end beam, each steering wheel assembly being pivotable about a vertical axis and having a locking mechanism for selectively locking one or both of the steering wheels at a desired angular position. A pair of castor wheel assemblies are removably attached adjacent the ends of the second end beam.

In one embodiment of the invention, the upper edge of the skirt is supported by rigid tubular members which are threaded through a loop formed in the skirt and supported by moveable support means on the side frames. The lower edge of the skirt is positioned by the movement of extension arms which telescope from the end beams and side frames to a desired position relative to the surface being sprayed. The lower end of each extension arm has an engagement means, such as a receiving hook, for engaging an elastic cord defining the lower edge of the skirt. Thus, by adjusting the extension arms, the lower edge of the skirt may be positioned adjacent the surface being sprayed such that outside wind or air movement cannot affect the spray. Likewise, overspray cannot escape the enclosure. Further, the elastic lower edge of the skirt is flexible and thereby can be easily raised to permit the enclosure to be moved over protrusions from the surface, without raising the entire frame structure.

In an alternative embodiment, the enclosure is designed such that none of the wheels traverse the area which has just been sprayed. This embodiment is used where a slow drying top coat is sprayed over the polyurethane foam underlayer. Some top coats require several hours for curing, and thus this alternative design permits spraying the top coat without the wheels of the enclosure traversing the area which has been sprayed. Specifically, the structure includes a frame defining a plurality of side walls with a mesh covering enclosing the frame to form an enclosure with only the bottom adjacent the surface opened. Steering wheels are attached on one side of the frame and a steering assembly is attached to and extends from that side of the frame. The steering assembly has a castor wheel attached thereon at a point removed from the frame such that the frame is cantilevered to one side of the steering wheels. A ballast is positioned on the steering assembly such that the frame, and the enclosure defined thereby, are supported over the surface. In this way, the enclosure may be moved on a roof surface in such a way that the wheels do not pass over the area which has just been sprayed from the enclosure.

BRIEF DESCRIPTION OF THE DRAWINGS

For a more complete understanding of the present invention, and for further details and advantages thereof, reference is now made to the following Detailed Description taken in conjunction with the accompanying drawings, in which:

FIG. 9 is a schematic view showing an alternative embodiment to the embodiment of FIGS. 7 and 8; and FIG. 10 is a perspective view showing an alternative embodiment to the embodiment of FIGS. 1 through 6.

DETAILED DESCRIPTION

Figure 1:
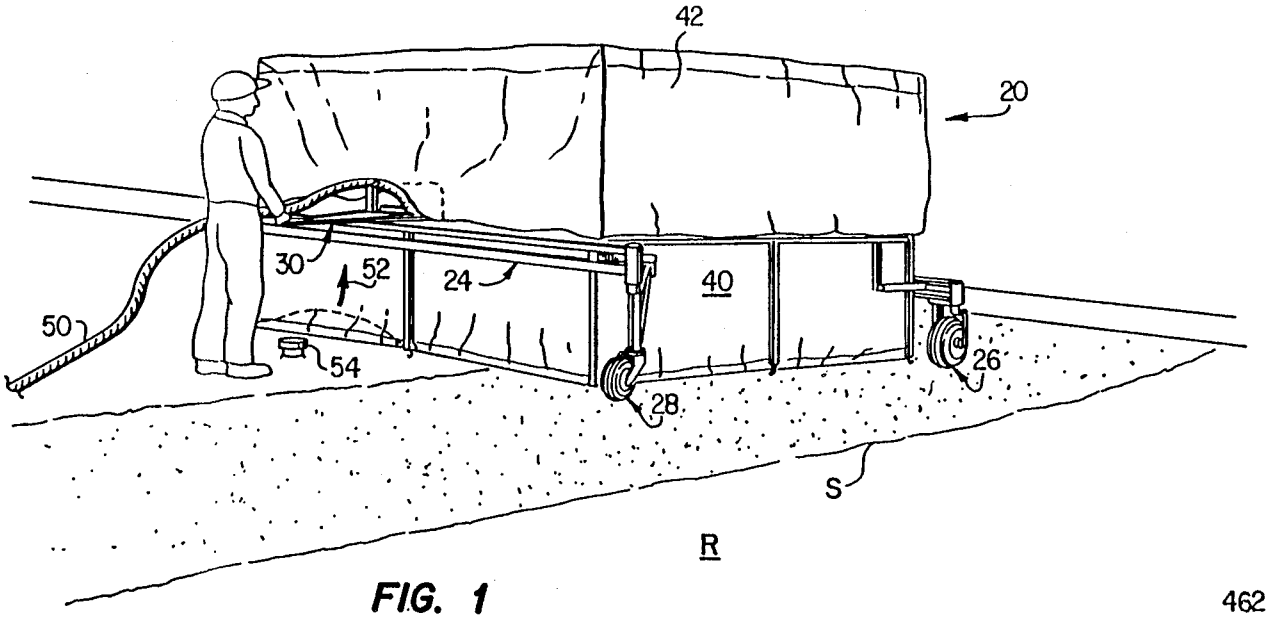
FIG. 1 is a perspective view of one embodiment of the enclosure of the present invention.

Referring to FIG. 1, the present invention includes a maneuverable enclosure 20 consisting of a modular tubular frame 24. Frame 24 is supported by a pair of steering wheel assemblies 26 (only one shown in FIG. 1) and a pair of castor wheel assemblies 28 (only one shown in FIG. 1). A steering arm assembly 30 is attached to frame 24. The lower portion of the enclosure is defined by a mesh skirt 40 which is positioned on the inside of frame 24 and a mesh top canopy 42 which is positioned over the upper portion of frame 24. Enclosure 20 is of an appropriate size such that a workman may operate a spray gun for depositing material, such as polyurethane foam, on the surface over which the enclosure is moved. In FIG. 1, hose 50 is provided for delivery of such spray material into the enclosure where a workman operates to deposit such material on roof top R in strips S.

Mesh skirt 40 has a lower edge which is positioned adjacent surface R but, as will be described hereinafter in greater detail, has an elastic cord positioned through the lower edge to permit the skirt to be raised, as identified by arrow 52 such that the enclosure may move over and past protrusions 54 which extend from the roof top.

Mesh skirt 40 and mesh top canopy 42 are constructed from a mesh having openings therethrough to permit complete ventilation into the enclosure. The mesh also precludes movement of overspray of the sprayed material out of the enclosure. Likewise, the mesh enclosure prevents wind or other air movement from interfering with the spraying process. A mesh having openings of from 20 to 50 mils has been found to be appropriate in the preferred embodiment.

Figure 2:
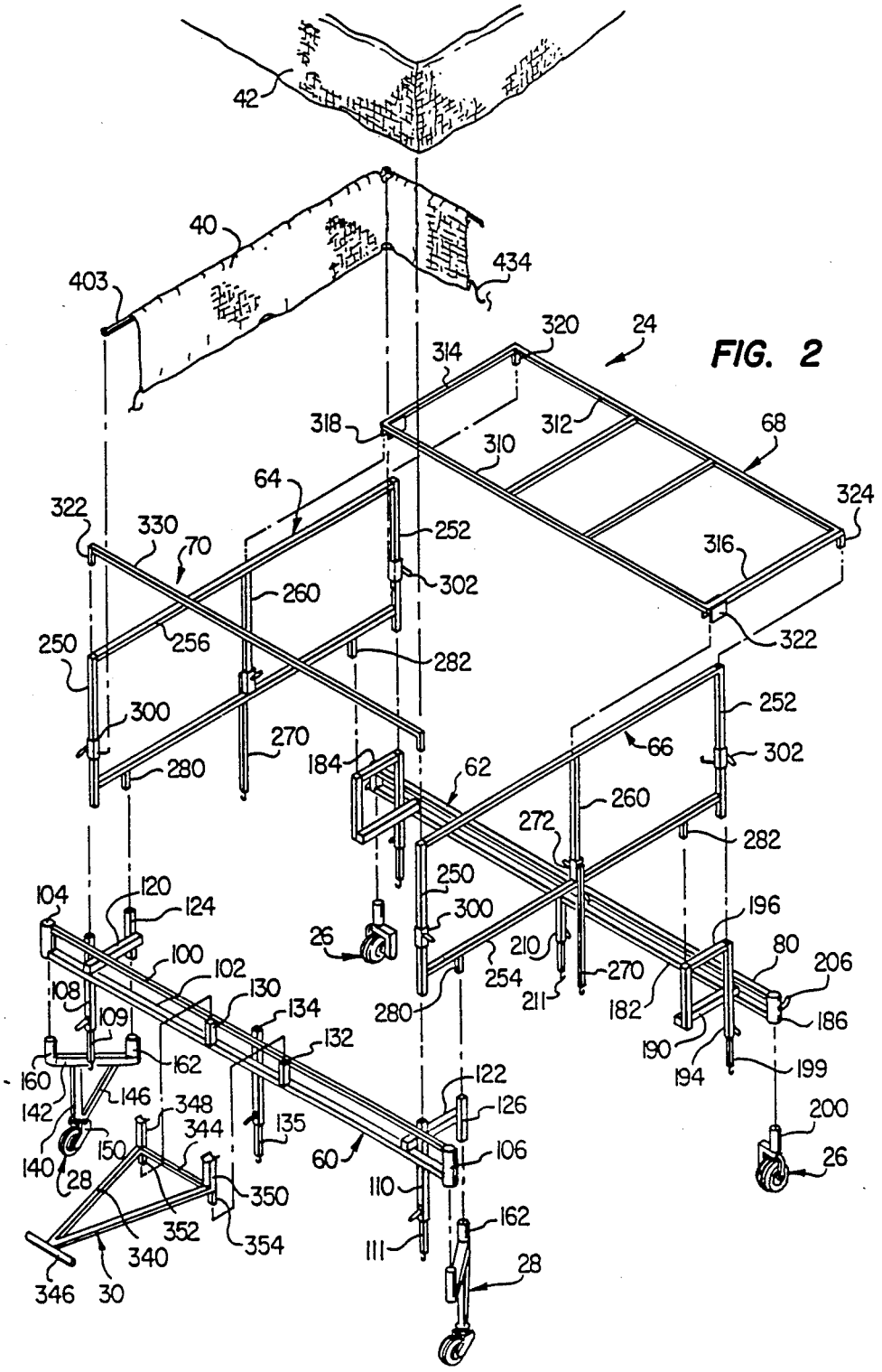
FIG. 2 is an exploded view of the enclosure shown in FIG. 1, with the mesh skirt and mesh top canopy broken away for clarity.

Referring to FIG. 2 in conjunction with FIG. 1, the structure of frame 24 and wheel assemblies 26 and 28 are shown in greater detail. In FIG. 2, skirt 40 and top canopy 42 are partially shown and are exploded from frame 24. Frame 24 consists of modular frame components which all are readily connected by simple sliding engagements. However, once the frame is assembled, an extremely rigid but lightweight structure is formed.

Referring to FIG. 2, frame assembly 24 includes front and rear headers 60 and 62, respectively, connected by side frames 64 and 66. The upper portion of side frames 64 and 66 are connected by top frame 68 and frame bar 70. Castor wheel assemblies 28 are slidably engaged onto the ends of front header 60 and steering wheel assemblies 26 are slidably engaged into the ends of rear header 62. Steering arm assembly 30 is slidably engaged into header 60.

Referring to the frame structure in more detail, end beam 60 includes upper and lower tubular members 100 and 102, respectively, attached in a parallel relationship by end sleeves 104 and 106. Members 100 and 102 are also connected by transverse tube sections 108 and 110. Transverse tubes 108 and 110 have telescoping tubes 109 and 111 extending therefrom as will be described hereinafter in greater detail. Transverse tube sections 120 and 122 extend out of the plane of end beam 60 and are attached, such as by welding, to both tube 102 and to transverse tube sections 108 and 110, respectively. Smaller tube sections 124 and 126 are attached at the distal end of tube sections 120 and 122, respectively, and are spaced from and parallel to transverse tube sections 108 and 110, respectively. A pair of steering assembly receiving tubes 130 and 132 are attached to and extend upwardly from tube member 102 and a center transverse tube 134 is attached at or near the center point of beam 60 attached between tube members 100 and 102.

Figure 3:
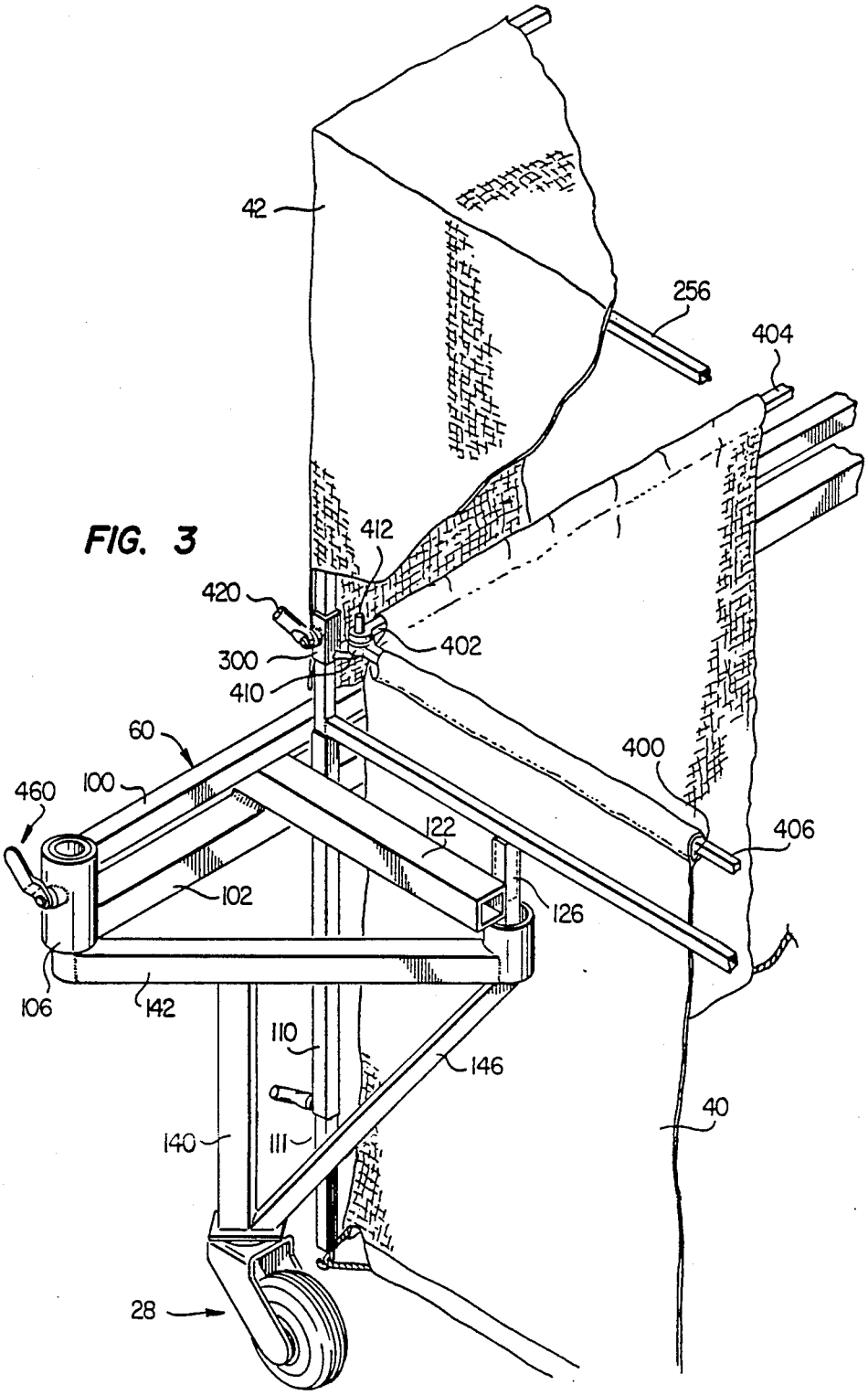
FIG. 3 is an enlarged perspective view showing one corner of the enclosure of FIG. 1, particularly identifying the attachment of one castor wheel assembly to the frame.

As can be seen in FIGS. 2 and 3, castor wheel assemblies 28 are identical one to the other. Referring to one such assembly, a triangular frame is defined having a vertical leg 140 and a top leg 142, with the triangular assembly completed by leg 146. A castor wheel and frame 150 are attached for castor movement at the juncture of legs 140 and 146. A pin tube 160 is attached to one end of leg 142 and a sleeve 162 is attached to the opposite end. Pin tube 160 is slidably received within sleeve 104 of header 60, and sleeve 162 receives tube 124 therein.

Rear header 62 includes an upper and lower tube 180 and 182, respectively, positioned in spaced, parallel relation and joined at their ends by sleeves 184 and 186, respectively. A side frame receiving structure is attached from tubes 180 and 182 and includes transverse tube 190 which is welded between tube 180 and 182. This structure further includes vertical tubes 192 and 194 positioned in a spaced, parallel relationship joined by tube 190 and upper tube 196 connecting the upper ends thereof. This structure is attached to rear header 62 adjacent both ends thereof.

Figure 4:
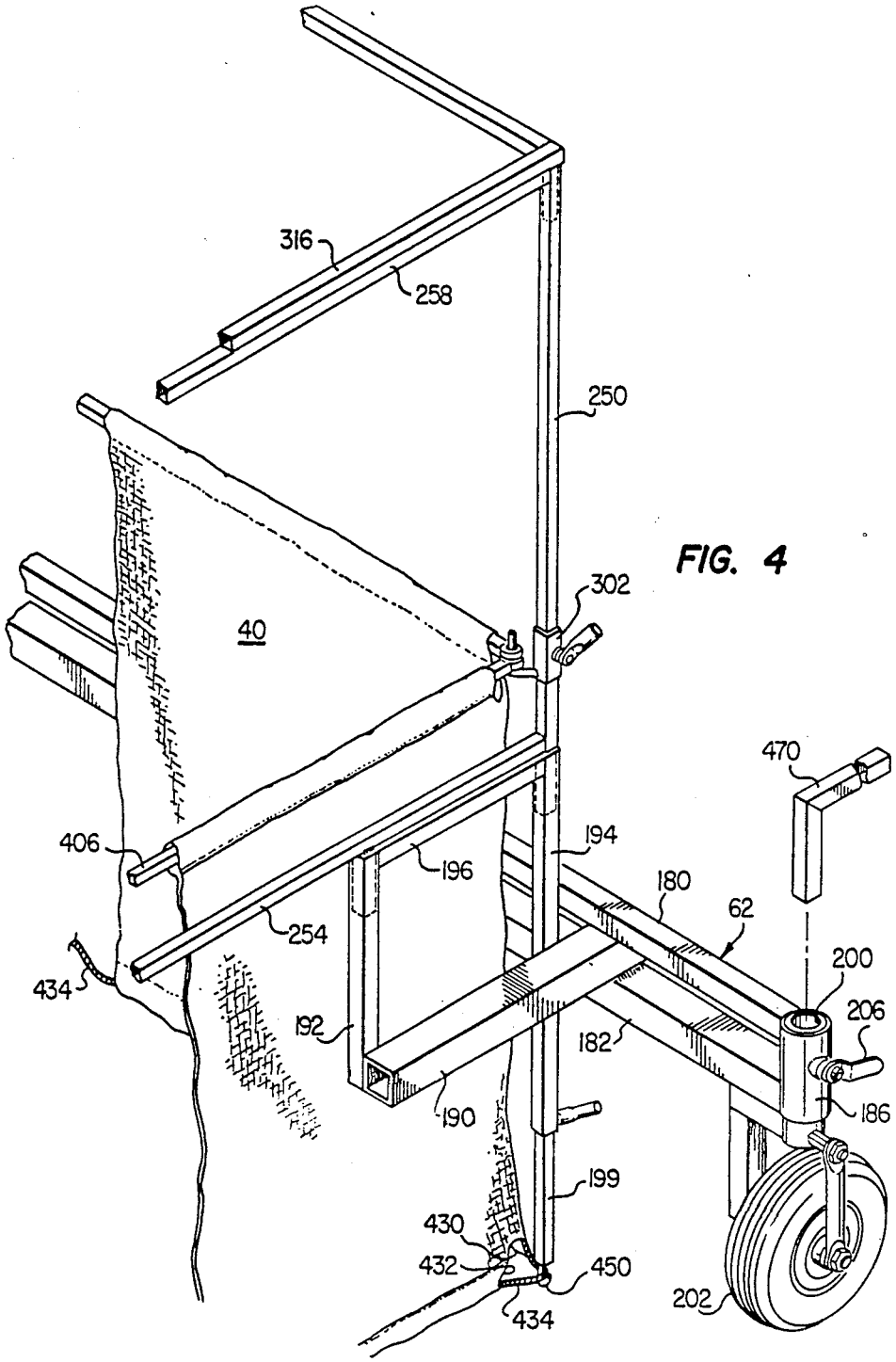
FIG. 4 is an enlarged perspective view of another corner of the enclosure shown in FIG. 1, specifically illustrating the attachment of one steering wheel assembly to the frame.
Figure 5:
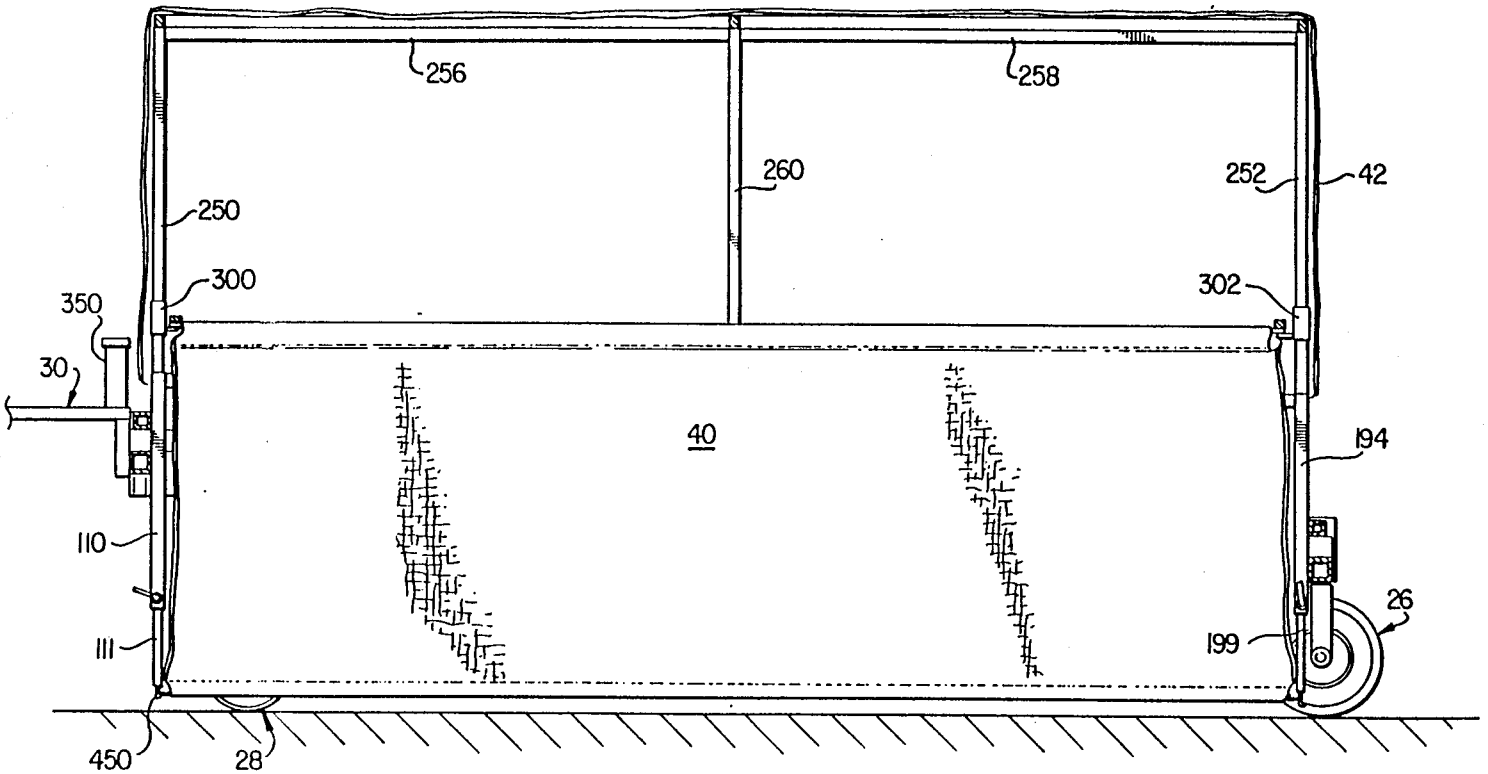
FIG. 5 is a vertical section view taken of the enclosure shown in FIG. 1.

As can be seen in FIGS. 2 and 4, steering wheel assemblies 26 include a tubular pivot shaft 200 with a wheel assembly 202 attached thereto. Shaft 200 is slidably received within sleeves 184 and 186 of header 62. A locking mechanism 206, hereinafter described in greater detail, is mounted on sleeve 186. A skirt positioning tube 210 is attached between tubes 180 and 182 of rear header 62 at an intermediate point thereof.

A telescoping extension tube 135 is positioned within and extends from tube 134 as will be described hereinafter in greater detail. Likewise, extension tubes 199 and 211 telescope into and extend from tubes 198 and 210, respectively, as will be described hereinafter in greater detail.

Side frames 64 and 66 are identical in structure. Referring to side frame 64, the frame includes upright side tubes 250 and 252 connected by a lower tube 254 and upper tube 256. A center tube 260 is positioned between tubes 254 and 256 at the midpoint thereof. A lower adjustment tube 270 is attached for sliding movement relative to tube 260, having a sleeve 272 attached thereto with a locking mechanism on sleeve 272 for fixing tube 270 relative to tube 260. A pair of positioning tube sections 280 and 282 extend downwardly from tube 254 for alignment and registration within tube 124 of front header 60 and tube 192 in rear header 62. At the time of attachment of side frame 64 for coupling front header 60 with rear header 62, the lower end of tubes 250 and 252 are also received within transverse tube 108 of header 60 and tube 194 of header 62. As can be seen in FIG. 2, the same registration and attachment is made with respect to side frame 66.

As will be described hereinafter in greater detail, skirt positioning sleeve 300 and 302 are slidably engaged on tubes 250 and 252, respectively.

Frame 24 is completed by the attachment of a top frame and top frame bar 68 and 70, respectively. Top frame 68 includes a rectangular frame composed of tubes 310 and 312 connected in a spaced, parallel relationship by tubes 314 and 316. Tube sections 320 and 324 extend from two corners of the top from 68, perpendicular to the plane defined by tubes 310 through 316, and are slidably received within tubes 252 of side frames 64 and 66. Saddle fittings 318 and 322 are welded at the other corners of top frame 68 and engage tubes 256 over the point of connection of tube 260 thereto. Further, an inner frame 326 may be supported between tubes 310 and 312 of top frame 68 for adding an exhaust fan and filter trap to the enclosure if desired. Frame bar 70 includes an upper tube 330 having a pair of leg tubes 332 and 334 extending perpendicularly therefrom for engagement within tubes 250 of side frames 64 and 66.

Referring still to FIG. 2, steering arm assembly 30 includes a triangular frame consisting of tubes 340, 342 and 344 with a handle 346 attached at the apex thereof. At the corners of the base of steering arm assembly 30, hose support brackets 348 and 350 are formed with tube sections 352 and 354 extending therebelow for registration within tubes 130 and 132 on front header 60.

The structure of mesh skirt 40 and mesh top canopy 42 is best shown by reference to FIG. 2 in conjunction with FIG. 3. Referring to these figures, mesh skirt 40 includes an elongate strip of mesh material having a length greater than the perimeter of the frame. The upper edge of skirt 40 is sewn over itself to form a loop 400. This top edge is interrupted by cutouts 402 which are spaced one from the other by a length which is slightly more than the dimension of one side of the frame assembly. Loops 400 are sized to receive tubes 404 and 406 which have rings 408 and 410, respectively, attached on the ends thereof.

Referring to FIG. 3, rings 408 and 410 are sized to engage pin 412 which is attached to skirt positioning sleeve 300. As can be seen in FIG. 3, skirt positioning sleeve 300 has a locking means 420 in the form of a handle having a threaded pin which engages a threaded nut welded to sleeve 300. By turning the handle of locking mechanism 420, the threaded pin is made to engage tube 250 and thereby fix the position of sleeve 300 relative to tube 250. A similar arrangement is provided at each corner of the frame structure such that the upper edge of mesh skirt 40 can be positioned as desired relative to the side walls of the frame assembly 24. It will also be noticed, particularly from viewing FIGS. 3 and 4, that the skirt is positioned interiorly of headers 60 and 62 and interiorly of side frames 64 and 66. The skirt is positioned around the entire perimeter of the frame with some overlap at the point of meeting of the ends thereof.

Referring now to FIGS. 2, 3 and 4, it can be seen that the lower edge of mesh skirt 40 is also looped onto itself and sewn in place to define loops 430. This lower edge is also interrupted by a plurality of cutouts 432 which are spaced equally with respect to cutouts 402 in the upper edge of skirt 40. An elastic cord 434 is engaged within loops 430 and is exposed at the cutouts 432 and 436.

As has been described in FIGS. 2, 3 and 4, each of tubes 108, 110, 134, 194, and 210 on headers 60 and 62 have an adjustable inner tube therein, and tubes 270 adjust relative to tubes 260 of side frames 64 and 66.

Figure 6:
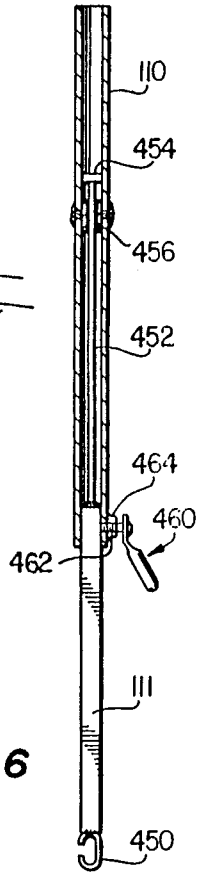
FIG. 6 is a somewhat enlarged section view showing the extension arm used for positioning the lower edge of the skirt of the enclosure of FIG. 1.

Tube 110 and its extendable tube 111 are shown in detail in FIG. 6 and is representative of each such extendable tube. On the lower end of tube 111, a C-hook 450 is welded thereto for receiving elastic cord 434 therein. A shaft 452 is welded to the upper end of tube 111 and has a follower piston 454 at the upper end thereof. Shaft 452 slides within a collar 456 which is positioned within tube 110 such that piston 454 engages collar 456 before tube 111 moves out of tube 110 in its lower most position. A lock mechanism 460 is shown in FIG. 6 and is identical to that described with respect to lock mechanism 420 shown in FIG. 3. Lock mechanism 460 includes a handle with a threaded pin 462 for engagement with a nut 464 attached to tube 110. By rotating the handle of lock mechanism 460, threaded pin 462 engages tube 111 such that its position relative to tube 110 can be selectively fixed as desired.

In view of this structure, it can be seen that the lower edge of skirt 40 can be easily adjusted with respect to wheel assemblies 26 and 28, and thus readily adjusted relative to the surface over which the apparatus moves by adjustment of tubes 109, 111, 199, 135 and 211 relative to the tubes in which they move, namely tubes 108, 110, 198, 134 and 210, respectively. Further, the lower edge of skirt 40 is defined by the position of elastic cord 434 which may be flexed, as shown in FIG. 1 by arrow 52, to permit the movement of the subject enclosure over and passed protrusions, such as protrusion 54 in roof R. Further, intermediate of the corners, the lower edge of the skirt is held in place at side frames 64 and 66 by being positioned in C-hooks attached to the lower end of tubes 270 and adjusting these tubes to the desired height. However, by adjusting tubes 270 to their full up positions, clearance up to tube 254 is provided if needed.

Referring to FIG. 3, a lock mechanism 460 is shown on sleeve 106 to secure castor wheel assembly 28 in its assembled position. Lock mechanism 460 is identical to that described above with respect to lock mechanism 460 on tube 110. Referring to FIG. 4, lock mechanism 206 is also shown and includes the same structure as that described above with respect to lock mechanism 460. As can be appreciated, steering wheel assembly 26 includes an axis shaft 200, in the form of a round tubular member attached to wheel assembly 202. In use of the enclosure, wheel assembly 202 is aligned as desired by rotating shaft 200 within sleeve 186 and then locking the wheel in position using lock mechanism 206. A handle 470 may be used for aligning the wheel assembly and has an engagement end 472 with a cross-section, such as square, for mating with a corresponding opening within circular shaft 200. By rotating handle 470, the position of wheel assembly 202 can be adjusted and then locked in place using lock mechanism 206.

As can be seen in FIG. 1, the material to be sprayed is fed into enclosure 20, by way of hose 50, to a workman within the enclosure who applies such material to the surface of roof R in the usual manner. The material is sprayed in any desired strip width as the enclosure is moved such that the workman maintains a position somewhat in the center of the enclosure, but moving from side to side as necessary. As a result of the mesh material which is used both for the skirt and the top canopy, the assistant on the outside of the enclosure can readily see the progress made by the workman within the enclosure and the speed of the movement of the enclosure can be adjusted accordingly. Of course, the workman within the enclosure may move from side to side or from back to front, as desired to provide the proper overlay of material as is well known in the art.

Therefore, the present invention describes a readily moveable enclosure which permits ease of assembly, wherein the components slidably engage one into the other. In fact, the entire structure is assembled without any fastening means whatsoever, such as bolt and nut connections but rather is rigidly formed by merely slidable engagements of one component into another. The enclosure permits full adjustment of an interiorly positioned mesh skirt relative to the frame. The structure has in-place locking means for holding the components together Further, the positionment of the mesh skirt within the frame protects the frame components from any overspray thus eliminating the possibility of interference with the set up and break down of the components making up the frame.

It will also be appreciated that the entire enclosure is defined by a mesh material supported by a moveable frame, and such mesh material both reduces the weight of the structure, allows ventilation to the structure, and permits visual observation both into and out of the structure. Further, use of the enclosure completely isolates the sprayer from the effects of wind and other air movement which would otherwise cause a substantial amount of overspray. Use of the enclosure therefore permits a more even application of material, such as polyurethane foam, and thus results in a superior job. Further, because the enclosure effectively eliminates the effect of outside wind on the application of the material, very little of the material is actually applied to the mesh skirt or top canopy. In a further embodiment of the invention, an application of silicone can be applied to the skirt such that any mist or spray which is lodged on the skirt, sticks thereto but may be removed by merely "shaking the skirt out" after the job is complete.

Further, storage of the unit on roof top is greatly facilitated by the design of the present invention. First, the top canopy can be removed within a matter of seconds and thus the majority of resistance which would otherwise be developed by the enclosure is effectively negated by simply removing this portion of the structure. Further, the wheel assemblies may be removed simply by unlocking the lock mechanisms and raising the frame to disengage the sliding connection between the wheel assemblies and the frame structure. With the wheel assemblies removed, the frame can simply be positioned on the surface and the unit can safely be left in place on the roof until the next day's job. Further, when the job is complete, the unit may be dismantled in minutes and can be lowered from the rooftop piece by piece without requiring any heavy equipment.

In a preferred embodiment of the invention, the frame components are constructed primarily from one inch and one and one-quarter inch steel tubing. However, it will be appreciated by those skilled in the art that other sizes can be used to accommodate the structural needs required for the final structure. Such variations may be dictated by the overall size of the final enclosure, it being understood that larger and smaller sizes can be constructed as needed to accommodate particular jobs which are to be performed. In a preferred embodiment of the invention, the enclosure has an overall frame dimension of twelve feet long by ten feet wide with six feet, six inches inside height. Thus, the unit accommodates approximately eighty square feet of spray area.

Figures 7, 8:
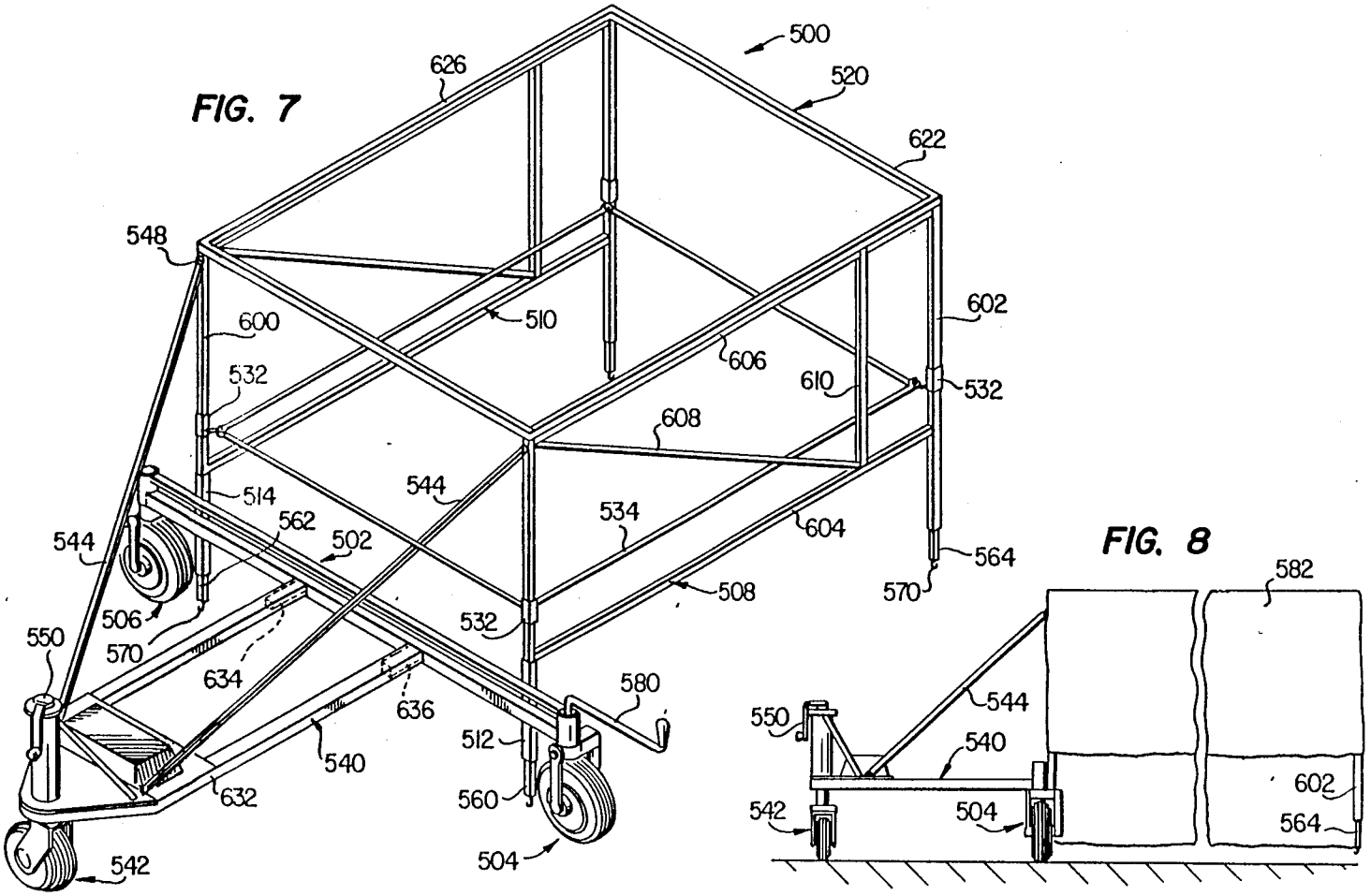
FIG. 7 is a perspective view of an alternative embodiment of the enclosure of the present invention, shown without the mesh skirt or mesh top canopy.
FIG. 8 is a plan view of the alternative embodiment of FIG. 7, showing the enclosure with the mesh skirt and mesh canopy in position.

The embodiment illustrated in FIGS. 1 through 6 depicts an enclosure which is used with the spraying of polyurethane foam, whereby the foam sets up almost immediate such that both workmen and equipment may move over the foam immediately after application. After completing the spraying of polyurethane foam, a protective coating is generally applied thereover. Such coating does not set up for a period of hours and thus the use of an alternative embodiment, illustrated in FIGS. 7 and 8 herein, is provided for accommodating the application of such top coating material. In the embodiment of FIGS. 7 and 8, a frame assembly 500 is provided which is cantilevered over the area being sprayed. Frame assembly 500 includes a single header 502 with wheel assemblies 504 and 506 slidably engaged in the ends thereof. Side frames 508 and 510 are slidably engaged into tubes 512 and 514 which are a part of header 502. The upper ends of side frames 508 and 510 are held in a spaced relationship by a top frame 520. The upper edge of a mesh skirt 530 (FIG. 8) is positioned relative to the frame using skirt positioning sleeves 532 which are slidably adjustable on the vertical members of side frames 508 and 510 as described hereinbefore with respect to the embodiment of FIGS. 1 through 6. Skirt support bars 534 are supported by skirt positioning sleeves 532 as described with respect to the first embodiment.

As can be seen in FIG. 7, side frames 508 and 510 are identical and only one will be described in detail. Specifically referring to side frame 508, it includes vertical tubes 600 and 602 maintained in a spaced relationship by lower and upper rails 604 and 606, respectively. A diagonal strut 608 is welded in place as is a vertical stiffener 610 to provide rigidity. The lower end of tube 600 is slidably received within tube 512 of header 502 to join side frame 508 to the header.

Top frame 520 includes front and rear tubes 620 and 622 spaced in a parallel relationship by connecting side members 624 and 626. As described with respect to the first embodiment, a connection tube is attached at each corner and aligned perpendicular from the plane of top frame 520. This connection tube is slidably received within tubes 600 and 602 of side frames 508 and 510, respectively.

A steering arm assembly 540 extends from header 502 and has a steering wheel assembly 542 attached remote from header 502. Tie rods 544 connect the end of steering arm assembly 540, adjacent wheel assembly 542, to side frames 508 and 510 at coupling points 546 and 548, respectively. Steering arm assembly 540 has a screw assembly 550 which may be used to vertically adjust steering wheel 542 relative to steering arm assembly 540 such that frame assembly, and particularly the side of the frame assembly 500 remote from wheel assemblies 504 and 506, may be adjusted relative to the surface. A ballast 558 is positioned on a cross-member on steering arm assembly 540 and is of sufficient weight to support the frame assembly in a cantilevered position.

Steering arm assembly 540 includes a pair of horizontally positioned tubes 630 and 632 which are slidably received over tube sections 634 and 63 from header 502 thereby connecting header 502 to the steering assembly. As can be appreciated, in the assembled form, the weight of frame assembly 500 assures that header 502 is firmly engaged against steering assembly 540 as a result of the assembly of components as shown.

As described with respect to the embodiment of FIGS. 1 through 6, adjustment of the bottom edge of mesh skirt 530 is provided by the vertical adjustment of tubes 560 and 562 from tubes 512 and 514, respectively. Similarly, tubes 564 and 566 are vertically adjustable relative to side frames 508 and 510, respectively, and position the lower edge of skirt 530 relative to the surface as desired. As with respect to the first embodiment, skirt 530 has an elastic cord defining the lower edge thereof which is engaged in C-hooks 570, attached to the lower ends of positioning tubes 560, 562, 564 and 566. As described with respect to the embodiment of FIGS. 1 through 6, the components of the alternative embodiment in FIGS. 7 and 8 are modular in that they may be connected and disconnected by sliding engagement of one component into the other. Also, the adjustment of wheel assemblies 504 and 506 about a vertical axis may be accomplished using a tool such as tool 580. With the wheel assemblies 504 and 506 adjusted as desired, they are locked in place using a locking mechanism as described with respect to steering wheel assemblies 26 in the embodiment of FIGS. 1 through 6.

The enclosure of the embodiment of FIGS. 7 and 8 is completed by the positioning of a top canopy 582 over the top of the frame structure as shown in FIG. 8. This top canopy is comparable in design to top canopy 42 described with respect to the embodiment of FIGS. 1 through 6.

Referring now to FIG. 9, a schematic representation is shown which depicts the embodiment of FIGS. 7 and 8 modified such that the dimensions of the frame can be extended or retracted as desired. As is shown in FIG. 9, such dimensions can be extended by merely designing side frames 508 and 510 such that the tubes 604 and 606 are made in two pieces and are telescoped one into the other. Locking mechanisms, such as locking mechanism 460 shown in the first embodiment, may be used to secure the two-component tubes in a desired position. Of course, in this embodiment, skirt support tubes 534 would also be increased in length as required. It will also be appreciated that the width of the enclosure can also be made adjustable by designing header 502 such that it also is a two-piece, telescoping section. Modifications would then be made in the steering arm assembly 540 and top frame to accommodate this adjustable feature.

FIG. 10 further illustrates the few modifications to the embodiment of FIGS. 1 through 6 which would be required to provide an enclosure according to the present invention which could be converted from a four-wheel system to the three-wheel, cantilevered design of the embodiment of FIGS. 7 and 8. Elements which are identical to those in the embodiment of FIGS. 1 through 6 are represented by the same number. In this alternative embodiment, header 60 is modified by the addition of tube sections 634' and 636' for receiving steering arm assembly 540 of the embodiment of FIGS. 7 and 8. The tie beams 544 of the embodiment of FIG. 7 would be employed and header 62 would simply be removed. A skirt adjustment telescoping tube 199 would be added into tubes 252 of side frames 64 and 66. While the embodiment of FIG. 10 shows the use of caster wheel assemblies 28, it may be preferred to use steering wheel assemblies 26 in lieu of the caster wheel assemblies. This is accomplished merely by substituting the steering wheel assemblies by inserting the tubular pivot shaft 200 thereof into sleeve 106 of header 60.

As can now be appreciated, the present invention provides a unique and versatile enclosure for use in applying a spray material on the surface over which the enclosure is moved. The enclosure includes a modular frame which may be easily and quickly assembled by sliding connection of the components one into the other to produce a frame defining a plurality of side walls with wheel assemblies for movably supporting the frame. A mesh skirt is supported by the frame adjacent the plurality of side walls and is positioned with its lower edge adjacent the surface. A mesh top canopy is positioned on the top of the frame with its lower edge overlying the upper portion of the skirt to form the enclosure. In one embodiment of the invention, a pair of steering wheels are used on one side of the frame and a pair of castor wheels on the other, and the assembly may be readily moved for spraying material, such as polyurethane, onto the surface therebelow. Use of the enclosure effectively eliminates the effect of wind and other air movement on the spraying operation and thus permits spraying in weather conditions which otherwise would not permit such activity. Further, because the enclosure eliminates the effect of wind and other air movement on the spray, a more uniform and thus a superior final result can be achieved.

In a second embodiment, an enclosure is provided which permits the positioning of the enclosure in a cantilevered fashion over the area to be sprayed. In this way, a complete roof or other surface can be traversed with the equipment in such a way that the wheel assemblies on which the enclosure operates need not traverse uncured coatings which have been sprayed. Thus, this enclosure permits complete traversal of a roof top using the enclosure even though the material being sprayed is of the type which does not set for several hours before equipment or workmen may operate on it.

Although preferred embodiments of the invention have been described in the foregoing Detailed Description and illustrated in the accompanying drawings, it will be understood that the invention is not limited to the embodiments disclosed, but is capable of numerous rearrangements, modifications, and substitutions of parts and elements without departing from the spirit of the invention. For example, it will be understood by those skilled in the art that the structure as described may be made in a larger or smaller size, in other than a rectangular shape and can be made of materials other than those described. The present invention is therefore intended to encompass such rearrangements, modifications, and substitutions of parts and elements as fall within the scope of the invention.

I claim:

1. A moveable enclosure for use in applying a sprayed material on a surface over which the enclosure is moved comprising:

a frame defining a plurality of side walls, roller means movably supporting said frame, a skirt supported by said frame, said skirt extending adjacent the plurality of side walls and positioned with a lower edge thereof adjacent to the surface, and a top canopy positioned on top of said frame having a lower edge overlying an upper portion of said skirt to form the enclosure.

2. The enclosure according to claim 1 wherein said skirt is positioned within said frame.

3. The enclosure according to claim 1 further comprising means for vertically adjusting said skirt relative to the frame.

4. The enclosure according to claim 3 wherein said means for adjusting said skirt relative to said frame comprises first means for vertically adjusting the upper portion of said skirt relative to said frame and second means for vertically adjusting the lower edge of said skirt relative to said frame.

5. The enclosure according to claim 1 further comprising skirt support means positioned within said frame for supporting the upper portion of said skirt interiorly of said frame.

6. The enclosure according to claim 1 wherein said frame comprises:

first and second end beams having ends thereon, said frames slidably engaging the ends of said end beams, said side frames comprising tubular members forming a rectangular planar frame with a pair of protrusions on each end thereof, which protrusions are engageable into receiving receptacles in said end beams, a top frame having engagement means for slidably engaging within each of said side frames.

7. The enclosure according to claim 6 wherein said top frame comprises tubular members forming a rectangular planar frame with protrusions extending from said top frame perpendicular to the plane of said top frame, said protrusion slidably engaging said end frames.

8. The enclosure according to claim 6 wherein said roller means comprises: a pair of steering wheel assemblies removably attached adjacent to the ends of said first end beam, each said steering wheel assembly being pivotable about a vertical axis with lock means for selectively locking said steering wheels at a desired angular position about the axis.

a pair of caster wheel assemblies removably attached adjacent to the ends of the second end beam.

9. The enclosure according to claim 6 further comprising skirt adjustment means which comprises:

selectively moveable support means on said end beams for selective vertical position of said support means relative to said end beams, skirt upper portion retention means for attachment to the upper portion of said skirt, said skirt upper portion retention means being removably engaged on said support means.

10. The enclosure according to claim 9 wherein said skirt adjustment means further comprises:

extension arms vertically expandable from said side frames and each having a lower end, means for selectively positioning said extension arms to a desired vertical position, engagement means on the lower ends of said extension arms for engaging and thereby positioning the lower edge of said skirt relative to said frame.

11. The enclosure according to claim 10 wherein said skirt has a means on the upper portion thereof for receiving a top support removably connected to said frame and the lower edge having an elastic cord attached there-along for engagement on said engagement means on the lower ends of said extension arms.

12. The enclosure according to claim 1 wherein said roller means comprises:

a pair of steering wheel assemblies removably attachable adjacent to a lower portion of one side of said frame, a castor wheel assembly attached on a steering arm extending from said one side of said frame and away from said frame, and a ballast weight positioned on said steering arm and of sufficient weight such that said frame is supported in a cantilevered position above the surface to be sprayed.

13. The enclosure according to claim 12 further comprising:

adjustment means for vertically adjusting said castor wheels relative to said steering arm to adjust said frame relative to the surface.

14. A moveable enclosure for use in spraying a building roof surface over which the enclosure is moved comprising:

a tubular upright frame having an open framework structure with sufficient height to accommodate a workman therein, a plurality of rollers attached to said frame such that said rollers but not said frame engage the roof surface, said rollers movably supporting said frame for movement over the roof surface, and a flexible covering supported from said frame to form an enclosure with only the bottom adjacent to the surface therebelow opened.

15. The enclosure according to claim 14 wherein a skirt portion of said covering is positioned within said frame.

16. The enclosure according to claim 15 further comprising means for vertically adjusting said skirt portion relative to the frame.

17. The enclosure according to claim 16 wherein said means for adjusting said skirt portion relative to said frame comprises first means for vertically adjusting an upper edge of said skirt portion relative to said frame and second means for vertically adjusting a lower edge of said skirt portion relative to said frame.

18. The enclosure according to claim 14 wherein said frame comprises:

first and second end beams having ends thereon, said frames slidably engaging the ends of said end beams, said side frames comprising tubular members forming a rectangular planar frame with a pair of protrusions on each end thereof, which protrusions are engageable into receiving receptacles in said end beams, a top frame having engagement means for slidably engaging within each of said side frames.

19. The enclosure according to claim 18 wherein said top frame comprises tubular members forming a rectangular planar frame with protrusions extending from said top frame perpendicular to the plane of said top frame, said protrusion slidably engaging said end frames.

20. The enclosure according to claim 18 wherein said roller means comprises:

a pair of steering wheel assemblies removably attached adjacent to the ends of said first end beam, each said steering wheel assembly being pivotable about a vertical axis with lock means for selectively locking said steering wheels at a desired angular position about the axis, a pair of castor wheel assemblies removably attached adjacent to the ends of the second end beam.

21. The enclosure according to claim 18 further comprising skirt portion adjustment means which comprises:

selectively moveable support means on said end beams for selective vertical positioning of said support means relative to said end beams, skirt upper edge retention means for attachment to the upper edge of said skirt, said skirt upper edge retention means being removably engaged on said support means.

22. The enclosure according to claim 21 wherein said skirt adjustment means further comprises:

extension arms vertically extendable from said side frames and each having a lower end, means for selectively positioning said extension arms to a desired vertical position, engagement means on the lower ends of said extension arms for engaging and thereby positioning the lower edge of said skirt relative to said frame.

23. The enclosure according to claim 22 wherein said skirt portion has a means on the upper edge thereof for receiving a top support removably connected to said frame an the lower edge having an elastic cord attached there-along for engagement on said engagement means on the lower ends of said extension arms.

24. The enclosure according to claim 14 wherein said roller means comprises:

a pair of steering wheel assemblies removably attachable adjacent to a lower portion of one side of said frame, a guide wheel attached on a steering arm extending from said one side of said frame and away from said frame, and a ballast positioned on said steering arm and of sufficient weight such that said frame is supported in a cantilevered position above the surface to be sprayed.

25. The enclosure according to claim 24 further comprising:

adjustment means for vertically adjusting said guide wheel relative to said steering arm to adjust said frame relative to the surface.

26. A movable enclosure for use in spraying a surface over which the enclosure is moved comprising:

an upright frame having an open framework structure, a plurality of rollers attached to said frame such that said rollers, but not said frame, engage the roof surface for movably supporting said frame for movement over the surface, and a flexible skirt supported from the frame and positioned interiorly thereof along the entire perimeter of the frame to form the enclosure, the bottom of said enclosure being open to expose the interior thereof to said surface.

27. The enclosure according to claim 26 further comprising means for vertically adjusting said skirt relative to the frame.

28. The enclosure according to claim 27 wherein said means for adjusting said skirt relative to said frame comprises first means for vertically adjusting an upper portion of said skirt relative to said frame and second means for vertically adjusting a lower edge of said skirt relative to said frame.

29. The enclosure according to claim 26 wherein said frame comprises:

first and second end beams having ends thereon, side frames slidably engaging the ends of said end beams, said side frames comprising tubular members forming a rectangular planar frame with a pair of protrusions on each end thereof, which protrusions are engageable into receiving receptacles in said end beams, a top frame having engagement means for slidably engaging within each of said side frames.

30. The enclosure according to claim 29 wherein said roller means comprises:

a pair of steering wheel assemblies removably attached adjacent to the ends of said first end beam, each said steering wheel assembly being pivotable about a vertical axis with lock means for selectively locking said steering wheels at a desired angular position about the axis, a pair of castor wheel assemblies removably attached adjacent to the ends of the second end beam.

31. The enclosure according to claim 29 further comprising skirt adjustment means which comprise:

selectively moveable support means on said end beams for selective vertical positioning of said support means relative to said end beams, skirt upper edge retention means for attachment to the upper edge of said skirt, said skirt upper edge retention means being removably engaged on said support means.

32. The enclosure according to claim 31 wherein said skirt adjustment means further comprises:

extension arms vertically extendable from said side frames and each having a lower end, means for selectively positioning said extension arms to a desired vertical position, engagement means on the lower ends of said extension arms for engaging and thereby position the lower edge of said skirt relative to said frame.

33. The enclosure according to claim 32 wherein said skirt has a means on the upper edge thereof for receiving a top support removably connected to said frame and the lower edge having an elastic cord attached there-along for engagement on said engagement means on the lower ends of said extension arms.

34. The enclosure according to claim 26 wherein said roller means comprises:

a pair of steering wheel assemblies removably attached adjacent to a lower portion of one side of said frame, a castor wheel assembly attached on a steering arm extending from said one side of said frame and away from said frame, a ballast positioned on said steering arm and of sufficient weight such that said frame is supported in a cantilevered position above the surface to be sprayed.

35. A moveable enclosure for use in spraying a material on a building roof structure surface over which the enclosure is moved comprising:

a frame having an open framework structure, said frame being positioned on said roof surface, roller means for movably supporting said frame, a flexible sidewall covering supported by said frame and adjustable relative to said frame at a bottom edge of the covering adjacent to the surface to permit positioning of the bottom edge to a position adjacent to the surface, and a top section positioned on top of said frame to complete the enclosure.

36. The enclosure according to claim 35 wherein said frame comprises:

first and second end beams having ends thereon, side frames slidably engaging the ends of said end beams, said side frames comprising tubular members forming a rectangular planar frame with a pair of protrusions on each end thereof, which protrusions are engageable into receiving receptacles in said end beams, a top frame having engagement means for slidably engaging within each of said side frames.

37. The enclosure according to claim 36 wherein said top frame comprises tubular members forming a rectangular planar frame with protrusions extending from said top frame perpendicular to the plane of said top frame, said protrusion slidably engaging said end frames.

38. The enclosure according to claim 36 wherein said roller means comprises:

a pair of steering wheel assemblies removably attached adjacent to the ends of said first end beam, each said steering wheel assembly being pivotable about a vertical axis with lock means for selectively locking said steering wheels at a desired angular position about the axis, a pair of castor wheel assemblies removably attached adjacent to the ends of the second end beam.

39. The enclosure according to claim 35 wherein said roller means comprises:

a pair of steering wheel assemblies removably attachable adjacent to a lower portion of one side of said frame, a castor wheel assembly attached on a steering arm extending from said one side of said frame and away from said frame, a ballast weight positioned on said steering arm and of sufficient weight such that said frame is supported in a cantilevered position above the surface to be sprayed.

40. A moveable enclosure for use in applying a material on a surface over which the enclosure is moved comprising:

a frame defining a plurality of side walls with sufficient height to accommodate a workman therein, a flexible covering for said frame to form an enclosure with only the bottom adjacent to the surface opened, steering wheels attached on one side of said frame, a steering assembly attached to and extending from the side of said frame on which said steering wheels are attached and having a guide wheel attached thereon at a position removed from said one side of said frame, and a ballast positioned on said steering assembly such that said frame is cantilevered to the side of said one side of said frame opposite said steering assembly, said weight being sufficient to maintain said frame elevated over the surface.

41. The enclosure according to claim 40 wherein said frame comprises:

first and second end beams having ends thereon, said frames slidably engaging the ends of said end beams, said side frames comprising tubular members forming a rectangular planar frame with a pair of protrusions on each end thereof, which protrusions are engageable into receiving receptacles in said end beams, and a top frame having engagement means for slidably engaging within each of said side frames.

42. The enclosure according to claim 40 further comprising:

adjustment means for vertically adjusting said guide wheel relative to said steering arm to adjust said frame relative to the surface.

* * * * *